United States Patent [19]

Cardone

[11] 4,080,598

[45] Mar. 21, 1978

[54] SAFETY CIRCUIT FOR ELECTRIC DEVICE

[75] Inventor: Louis P. Cardone, Lima, Ohio

[73] Assignee: Wico Corporation, Niles, Ill.

[21] Appl. No.: 715,045

[22] Filed: Aug. 17, 1976

[51] Int. Cl.[2] ..... G08B 21/00

[52] U.S. Cl. ..... 340/421; 340/420; 340/261; 340/280; 194/97 R

[58] Field of Search ..... 340/421, 261, 253 C, 340/280, 420; 194/97 R, 10

[56] References Cited

U.S. PATENT DOCUMENTS

| | | | |
|---|---|---|---|
| 3,553,674 | 1/1971 | Head | 340/280 |
| 3,710,371 | 1/1973 | Whalen et al. | 340/280 |
| 3,742,480 | 6/1973 | Hoecker | 340/280 |
| 3,765,008 | 10/1973 | Lowry | 340/280 |
| 3,828,338 | 8/1974 | Kato | 340/261 |
| 3,836,901 | 9/1974 | Matto et al. | 340/261 |
| 3,924,254 | 12/1975 | Klebold et al. | 340/261 |

*Primary Examiner*—John W. Caldwell, Sr.
*Assistant Examiner*—Donnie L. Crosland
*Attorney, Agent, or Firm*—Biebel, French & Nauman

[57] ABSTRACT

A protective device for coin operated vending and game machines prevents machine operation and sounds an alarm for a predetermined time after either the machine is struck or power to the machine is interrupted.

3 Claims, 1 Drawing Figure

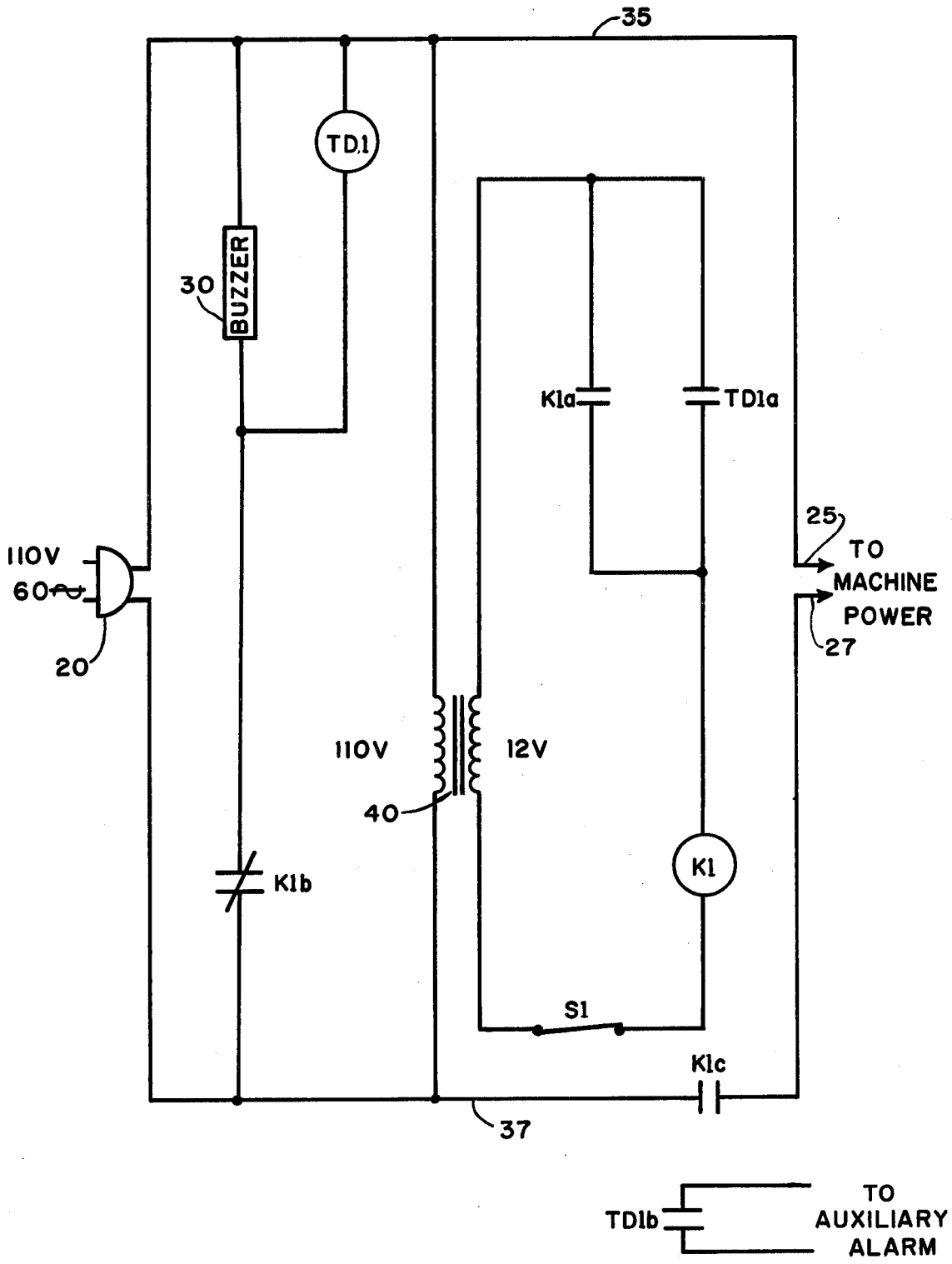
35
TD1
BUZZER
30
K1a
TD1a
25
TO
MACHINE
POWER
27
110V
60~
20
110V
12V
40
K1b
K1
S1
K1c
37
TD1b
TO
AUXILIARY
ALARM

SAFETY CIRCUIT FOR ELECTRIC DEVICE

BACKGROUND OF THE INVENTION

The present invention relates to coin operated vending and game machines and, more particularly, to protective circuitry which will prevent abuse of such machines. Coin operated, electrically powered machines are widely used for dispensing cigarettes, candy, soft drinks, pastry, etc. Game machines, such as pinball machines, are also generally coin operated and electrically powered. Such machines permit products and entertainment to be available to consumers at a variety of locations without the need for the continued presence of sales personnel.

Automatic vending and game machines are relatively expensive and, since they are left unattended, it is important to protect them from abuse by those who use them. If a machine should not operate to the satisfaction of the customer, it is not uncommon for the machine to be struck by the customer. Additionally, customers may believe that they can cause the machine to operate, without the insertion of coins into the coin slot, by sharply striking the machine near the coin receptive apparatus. Also, some types of vending and game machines may be actuated fraudulently by disconnecting and then rapidly reconnecting the electrical power to the machines. This may be accomplished by pulling the machine power plug from its outlet and then quickly reinserting it. While no damage is done to the machine by such a process, the machine owner will be defrauded and may suffer sizeable losses.

Several attempts have been made to discourage customers from striking machines in order to attempt to obtain free games or merchandise. U.S. Pat. No. 2,893,531 issued July 7, 1959, to Hebel shows an impact disconnect assembly in which the impact of a blow to the machine will cause the machine to be temporarily disabled. U.S. Pat. No. 3,482,110, issued Dec. 2, 1969, to Robinson shows a similar circuit arrangement. U.S. Pat. No. 2,178,276, to Breither, issued Oct. 31, 1939, shows an anti-theft device which senses a sharp blow to the coin slide and sounds an alarm in response to such abuse. U.S. Pat. No. 3,834,504 issued Sept. 10, 1974, to Hemming et al, shows an anti-fraud device for pay telephones in which a mechanical linkage arrangement is provided to prevent the telephone from being fraudulently actuated by striking the coin release button.

Although circuitry preventing operation after a power interruption has been used with machines such as compressors, as shown in U.S. Pat. No. 3,050,254, issued Aug. 21, 1962, to Blackett, no solution has been developed in response to the problem of fraudulent vending machine actuation by power interruption.

Thus a need exists for a device for protecting coin operated, electrically powered machines from various forms of abuse and for signalling when such abuse occurs.

SUMMARY OF THE INVENTION

A device for preventing abuse of coin operated, electrically powered machine and for sounding an alarm when such abuse occurs includes input terminal means connected to a power outlet and output terminal means connected to the electrically powered machine. A vibration sensing switch means is provided for sensing vibration of the machine. A timer means times a predetermined time period in response to machine vibration and in response to the interruption of power to the input terminal means. Means are provided for applying power from the input terminal means during normal machine operation, and for disconnecting the application of power to the output terminal means for the predetermined period of time timed by the timer means when the switch means senses machine vibration or when power to the input terminal means is interrupted. An alarm is also provided for indicating that the machine has been abused or that power has been temporarily interrupted. The buzzer is actuated during the time period timed by the timer means. An auxiliary alarm means is also provided to actuate an auxiliary alarm at a remote location.

Accordingly, it is an object of the present invention to provide a protective device for coin operated, electrically powered machines for preventing abuse of such machines and for preventing fraudulent actuation by temporarily interrupting the electrical power to such machines; to provide such a device in which the abuse of such machines or the attempt to fraudulently actuate such machines results in an alarm being sounded; and further, to provide such a device in which a remote alarm may also be actuated.

BRIEF DESCRIPTION OF THE DRAWING

The FIGURE is a schematic representation of the circuit embodying the present invention.

DETAILED DESCRIPTION OF THE PREFERRED EMBODIMENT

The present invention provides a protective arrangement for an electrically powered machine in which physical abuse of the machine is sensed, and an alarm sounded and the machine temporarily disabled in response to such abuse. When signs are posted indicating this feature and, further, when customers learn by experience that physical abuse of machines will only result in the machines being disabled, and an alarm being sounded, it is anticipated that such abuse will stop. The present invention also senses interruption of power to the machine and temporarily disables the machine and sounds an alarm indicating that an attempt has been made to fraudulently actuate the machine.

The single figure in the present application illustrates a preferred embodiment of the invention. An electrical connector 20 may be connected to a typical electrical power outlet supplying 110 volt, 60 cycle power. Output terminal means 25 and 27 will typically be connected to the machine power leads. The circuitry of the present invention may advantageously be incorporated into the machine cabinet in order to prevent terminal means 25 and 27 from being disconnected from the machine power leads, thus defeating the device. A vibration sensing switch means S1 is provided for sensing vibration of the machine. A timer means includes time delay relay TD1 comprising relay coil TD1 and normally open contacts TD1*a*. Connected in parallel with the coil of TD1 is an alarm 30 which may comprise a buzzer or other indicator device. Transformer 40 steps down the 110 volt power across line 35 and 37 and provides 12 volts at the transformer secondary. This allows switch S1 to operate at 12 volts rather than at 110 volts and thereby prevent arcing as switch S1 is momentarily opened by machine vibration.

Operation of the circuit is as follows. When the input terminal means 20 is connected to a 110 volt, 60 cycle source, power will be applied to lines 35 and 37, sounding buzzer 30 and actuating time delay relay TD1 through normally closed contacts K1*b*. Power will also be applied to the primary of transformer 40. At the end of a time period determined by timer TD1 and nominally 10 seconds, timer TD1 will time out and normally open contacts TD1a will close. Power will thereby be applied to the coil of relay K1 through vibration sensing means S1. This will result in the closing of normally open contacts K1*a* and K1*c* and the opening of normally closed contacts K1*b*. Buzzer 30 and the coil of timer TD1 will thereby be disconnected from line 37 and power will be applied to the machine. Relay K1 will lock itself in through contacts K1*a* and will thus remain activated even though contacts TD1*a* of the timer again return to their open position. The machine will thus be provided with power and will operate normally until either it is struck or until there is a momentary interruption in the power applied to input terminal means 20.

If, while the machine is powered, an attempt is made to actuate the machine by momentarily interrupting power to the machine, the circuit will prevent reapplication of power to the machine for a substantial period of time. When power is interrupted to the input terminal means 20, the voltage across the secondary of transformer 40 will drop to 0. Relay K1 will therefore be de-energized and contacts K1*a* will open. At the same time contacts K1*c* in line 37 will open, preventing further application of power to the machine through output terminal means 25 and 27. Contacts K1*b* will also close, resulting in actuation of buzzer 30 and initiation of the timing cycle of timer means TD1. The buzzer will continue to sound as timer means TD1 times through its cycle. At the end of the predetermined period of time, timer TD1 will time out, contacts TD1*a* will be closed, energizing relay K1 and resulting in resumption of the normal operating conditions of the circuit. Contacts K1b will open, causing buzzer 30 to be de-energized, while contacts K1c will close and machine power will be reapplied. Relay K1 will again lock itself in through contacts K1a.

If during the course of normal operation, the machine should be struck sharply, vibration sensing switch means S1 will sense this machine abuse. The switch S1 will be opened temporarily and, since the switch circuit is operating on 12 volt power, no arcing will result across the contacts. The opening of switch S1 will remove power from relay K1 and thus cause contacts K1*a* to open. As discussed above, this will open contacts K1c thus preventing application of power to the machine and, at the same time, cause contacts K1*b* to close and actuate buzzer 30 and the timer Td1. Assuming that the vibration was only temporary, switch S1 will immediately reclose and, at the end of the predetermined time period set by timer Td1, the circuit will resume its usual operating state and operation of the electrically powered machine may be resumed.

An auxiliary alarm may be actuated by means of auxiliary alarm means comprising contacts TD1*b*. These contacts will be closed only after the timer TD1 has advanced through its timing cycle. Thus the alarm condition will be one in which contacts TD1*b* are open. This may, of course, be changed by using contacts which are normally closed and sensing an alarm condition when these alarm contacts are closed.

While the form of apparatus herein described constitutes a preferred embodiment of the invention, it is to be understood that the invention is not limited to this precise form of apparatus, and that changes may be made therein without departing from the scope of the invention.

What is claimed is:

1. A device for preventing abuse of a coin operated, electrically powered machine by sounding an alarm when such abuse occurs, comprising:

input terminal means connected to a power source, output terminal means connected to the electrically powered machine, switch means for electrically connecting said input terminal means to said output terminal means, vibration sensing means for sensing vibration of said machine and for providing an output in response to said vibration, power sensing timer means for sensing interruption and reapplication of power to said input terminal means, and for providing an output in response to said interruption and reapplication for a predetermined time period after said reapplication of power, and switch control means, responsive to said power sensing timer means and to said vibration sensing means ffor actuating said switch means such that said input terminal means is disconnected from said output terminal means upon receipt of outputs from either said vibration sensing means or said power sensing timer means.

2. The device of claim 1 further comprising alarm means, responsive to said switch control means actuating said switch means, for sounding an alarm during said predetermined time period.

3. The device of claim 2 further comprising normally open auxiliary alarm contacts which are closed by said timed alarm means during the timing of said predetermined time period.

* * * * *